United States Patent [19]

Zürner et al.

[11] 4,278,233

[45] Jul. 14, 1981

[54] ARRANGEMENT FOR ACTUATING GAS-CHANGE VALVES

[75] Inventors: Hansjürgen Zürner, Ammerndorf; Wolfgang Fuhrmann, Nürnberg, both of Fed. Rep. of Germany

[73] Assignee: Maschinenfabrik Augsburg-Nürnberg Aktiengesellschaft, Nürnbert, Fed. Rep. of Germany

[21] Appl. No.: 74,321

[22] Filed: Sep. 11, 1979

[51] Int. Cl.[3] ..... F16K 31/122; F01L 1/04

[52] U.S. Cl. ..... 251/57; 123/90.12; 123/90.16

[58] Field of Search ..... 123/90.12, 90.13, 90.15, 123/90.16; 251/57

[56] References Cited

U.S. PATENT DOCUMENTS

| | | | |
|---|---|---|---|
| 1,690,032 | 10/1928 | Noble et al. | 123/90.12 |
| 2,126,885 | 8/1938 | Heintz | 123/90.12 |
| 2,329,662 | 9/1943 | Steiner | 123/90.12 |
| 2,602,434 | 7/1952 | Barnaby | 123/90.12 |
| 3,119,592 | 1/1964 | Fraschelti | 251/57 |
| 3,257,999 | 6/1966 | Fiedler | 123/90.12 |
| 3,306,270 | 2/1967 | McCarl | 123/90.12 |
| 4,106,446 | 8/1978 | Yamada et al. | 123/90.12 |

FOREIGN PATENT DOCUMENTS

| | | | |
|---|---|---|---|
| 2448311 | 4/1976 | Fed. Rep. of Germany | 123/90.12 |

*Primary Examiner*—Martin P. Schwadron
*Assistant Examiner*—G. L. Walton
*Attorney, Agent, or Firm*—Becker & Becker, Inc.

[57] ABSTRACT

A hydraulic system for actuating gas-change valves in internal combustion engines or compressors wherein the output piston associated with each gas-change valve is capable of being moved against the force of a closing spring through a control circuit filled with control fluid by an input piston operable by a cam, with means for venting the control fluid at the highest point of the hydraulic system, and wherein the input cylinder communicates with a system for refilling with control fluid. The means for venting the control fluid are formed as permanent venting means, a variable area restrictor determining the amount of control fluid in the hydraulic system during operation is provided which is located in a discharge circuit, and the cam actuating the output piston is formed with a pre-ramp and a post-ramp.

7 Claims, 1 Drawing Figure

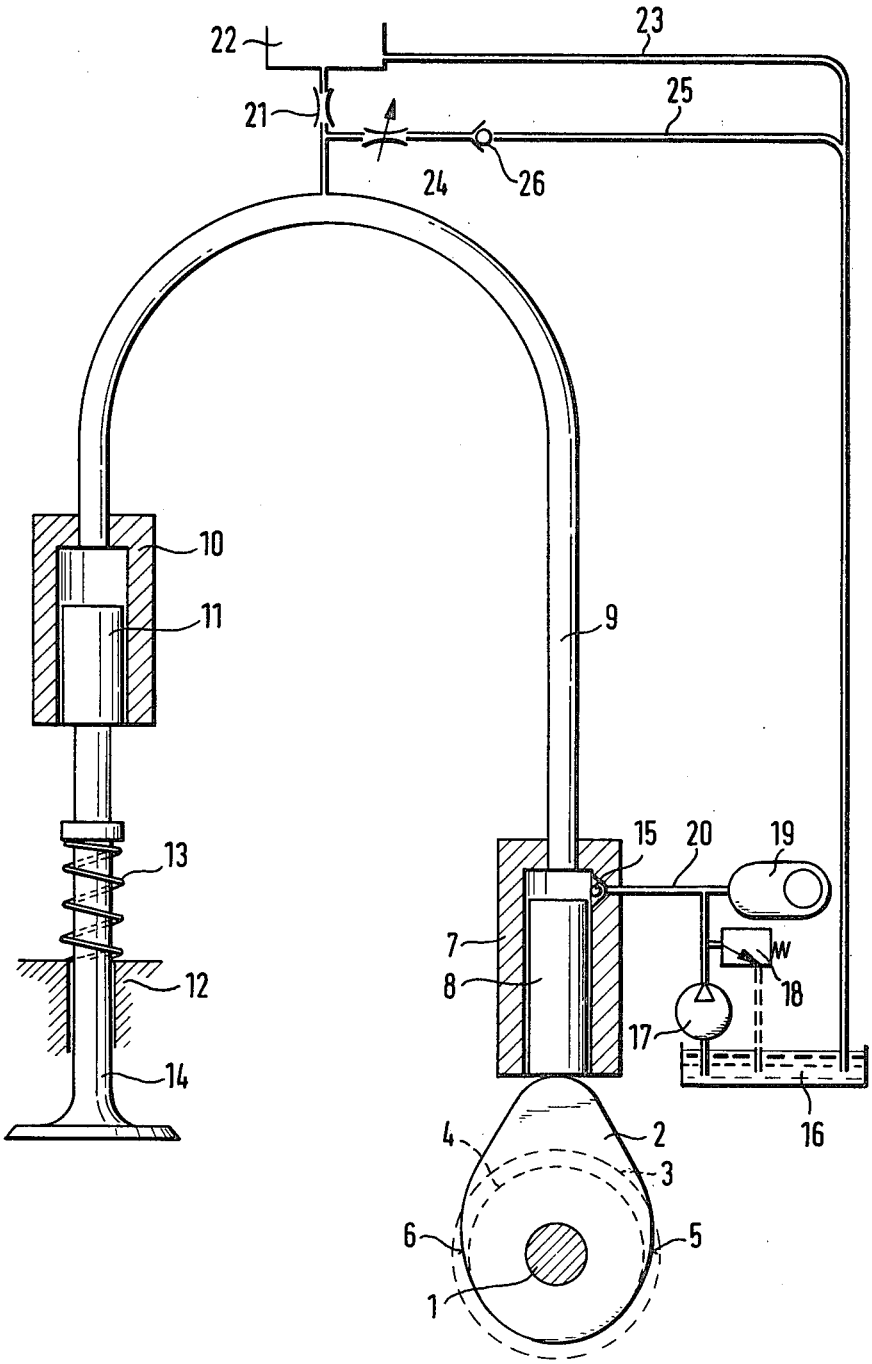
22
23
21
25
24
26
10
11
9
13
15
20
19
7
8
W
18
12
17
14
16
4
2
3
6
5
1

ARRANGEMENT FOR ACTUATING GAS-CHANGE VALVES

The present invention relates to an arrangement for actuating gas-change valves in internal combustion engines or compressors. In such arrangements, the output piston associated with each gaschange valve is capable of being moved—against the force of a closing spring via a control conduit filled with control fluid—by an input piston and the input piston is operable by a cam, with means being provided at the highest point of the system for removal of air, or for venting of the control fluid. The pertaining input cylinder communicates with a device for refilling the system with control fluid.

In a known system of this type the input piston delivers more control fluid to the output cylinder than is needed at such output cylinder to open the gas-change valve. The delivered excess control fluid forces open a discharge valve provided at the top of the output cylinder and thus returns to the reservoir through a discharge line or conduit. Thus, venting of the control fluid is effected during each valve lift and, at the same time, an excessive increase of the temperature of the fluid is avoided. After a lifting motion, just prior to returning to its initial position, due to the action of an additional closing spring, the input piston opens a suction valve provided in the input cylinder, whereby the complete hydraulic system is refilled with control fluid.

The repeated opening and closing of the discharge valve and the suction valve causes the complete hydraulic system to be continuously tapped alternately. This is liable to cause dangerous oscillations in the control fluid column, a phenomenon which is very frequently observed in the case of control ports which are opened and closed by spools, or in the case of accumulators connected by means of branch-off lines. Such oscillations often interfere with the complete control system and, at least, will affect the precise functioning thereof. Furthermore, the known system suffers from the drawback that the input piston—on completion of its working stroke, because of a deficiency of control fluid—will not return into its initial position on its own. Therefore, it is necessary, in addition to the valve closing spring in the input cylinder, to provide another closing spring.

A further similar hydraulic system is known having no means for venting the control fluid. The device for refilling this system with control fluid also communicates with the input cylinder and, at the same time, serves to vary the valve timing by varying the pressure of the control fluid which is admitted. This system includes a check valve fitted to the input cylinder, this check valve being ultimately controlled by the input piston, a pressure reservoir which is filled with control fluid by a pump from the reservoir, and a relief valve installed in a return conduit.

Also in this system there exists the danger that oscillations are caused in the hydraulic system because the input piston at the same time serves to open and close control ports and, if any losses due to leakage or pressure changes occur, the check valve will suddenly be opened and closed. Furthermore, tapping of the hydraulic system will occur and set up oscillations, if only because the check valve is connected to the input piston and does not close this off directly at its wall.

The system described involve straightforward "on/-off" control actions which means that the gas-change valve concerned is fully opened and fully closed again according to preset cycles. It is known, however, that the starting performance and the part load performance of air-compressing internal combustion engines is favorably influenced if provision is made for the lift of the inlet valve to be varied during operation. Also, it is frequently desirable to decrease the lift of the exhaust valve, namely, for braking the engine. Devices of this type are of course also known in the case of hydraulic valve gear, but these invariably involve even more tapping points in the hydraulic system and, in particular, more control ports, so that the occurrence of oscillations in the entire system cannot practically be avoided. For this reason, it is not necessary to further describe such known control systems here.

It is an object of the present invention to further develop a hydraulic system of the type initially referred to so as to render the lift of the gas-change valve to be infinitely variable during operation over a wide range, while avoiding dangerous oscillations in the hydraulic system, so that a trouble-free operation is ensured under all conditions.

This object and other objects and advantages of the invention will appear more clearly from the following specification in connection with the accompanying drawing, in which the single figure diagrammatically indicates a control system for a gas-change valve in accordance with one embodiment of the invention.

According to the present invention, this object is achieved by forming the means for venting the control fluid as permanent venting means, and that an adjustable restrictor determining the amount of control fluid in the hydraulic system during operation is arranged in a discharge conduit, and that the cam actuating the input piston is formed with a pre-ramp and post-ramp.

Due to permanent venting, not only is reliable de-aeration of the control fluid achieved, but any oscillations in the hydraulic system are thereby prevented. The venting means according to the invention essentially consist of a restrictor having a very narrow opening area which is preferably arranged at the highest point of the control line or conduit between the input cylinder and the output cylinder, it being desirable to make the rise of the control lines from both cylinders as uniform as possible. The restrictor is provided with known features to prevent clogging by solid constituents and it furthermore has a control fluid separator, connected downstream, for control fluid emitted in traces which finally is returned into the reservoir through a discharge conduit.

As a result of the adjustable restrictor, a greater or lesser amount of control fluid can be removed from the hydraulic system, whereby the lift of the gas-change valve can be infinitely varied. The control fluid discharged through the restrictor also returns through a discharge conduit which, for the purpose of suppressing foaming, serves as a steadying conduit, into the reservor, a check valve being provided immediately downstream of the restrictor as a protection against unintentional return flow of control fluid or air into the hydraulic system. Due to this arrangement, it is prevented from affecting the action in the control conduit, especially as far as the setting up of oscillations is concerned.

The pre-ramp provided on the cam produces the compression of the control fluid in the control conduit which is necessary in order to open the gas-change valve against the force of the valve closing spring. The compression takes place before the actual opening phase of the gas-change valve at a slow enough rate to prevent the setting up of oscillations in this regard, too. Similarly, and for the same reason, the pressure which still prevails in the control conduit after the closing of the gas-change valve is gradually decreased by the post-ramp.

The inevitable refilling of control fluid, which is necessary if only to make up for leakage losses in all hydraulic systems, is effected in a manner known per se at the point where the greatest risk exists of a negative pressure arising, namely, in the input cylinder. Due to the pre-ramp and the post-ramp, the acceleration action in the control circuits is mitigated so that the refilling valve is prevented from setting up any oscillations. In order to prevent any tapping arising which would be liable to set up oscillations, the refilling valve is in addition integrated directly in the input cylinder. Apart from that, the device for refilling control fluid consists in a manner known per se of a reservoir, a pump, a relief valve and an accumulator. These parts cannot set up any oscillations in the control conduit because they are separated from it by the refilling valve. It should also be mentioned that the control fluid used is preferably oil.

Further details of the invention will become apparent from the following description of one embodiment of the invention illustrated in the drawing.

On a camshaft 1, for example a camshaft for an internal combustion engine, a cam 2 is secured. The shape of cam 2 is governed by base circle 3. The base circle 3 is decreased to a circle 4 with the transitions from the circle 4 to the base circle 3 each forming a pre-ramp 5 and a post-ramp 6.

The cam 2 is adapted to actuate an input piston 8 slidably arranged in an input cylinder 7. A control conduit 9 leads from the input cylinder 7 to an output cylinder 10 in which an output piston 11 is slidably arranged. Output piston 11 is adapted to actuate a gas-change valve 14 which is slidably guided in its guide 12 and inherently urged to assume its closed position by a valve-closing spring 13.

For the purpose of refilling the hydraulic system with control fluid, there is provided a refilling valve 15 which is integrated in the input cylinder 7. The refilling valve 15 is supplied with the necessary control fluid via a conduit 20 by a refilling system including a reservoir 16, a pump 17, a relief valve 18, and an accumulator 19.

A permanent venting device for the control fluid is provided at the highest point of the control conduit 9. This venting device comprises a restrictor 21 with a very narrow opening area and a control fluid separator 22 which is connected downstream, whereby oscillations in the entire system are substantially avoided. Traces of the control fluid entering the separator 22 are returned through a discharge conduit 23 into the reservoir 16.

Directly adjacent to the restrictor 21, in the embodiment described, there is provided a variable-area restrictor of throttle 24 which serves to adjust the specific lift of the gas-change valve 14 as desired. The greater the amount of control fluid that is discharged through the throttle 24, the smaller is the lift of the gas-change valve 14. Discharged control fluid is delivered through a discharge conduit 25 provided with a steadying section into the reservoir 16, it being considered expedient to connect a check valve 26 downstream of the throttle 24. This will serve to prevent return flow of air or control fluid into the control conduit 9 in the event that the pump 17 should fail.

It may be mentioned here that the restrictor 21 for permanent venting and the throttle 24 may, in practice, be formed as an integral unit for varying the valve lift. This is not shown in the figure in order to more clearly indicate these individual parts. Of course, the throttle 24 may be located at any other point of the hydraulic system, for instance, on the output cylinder 10.

The invention is, of course, in no way restricted to the specific disclosure of the specification and drawing, but also encompasses any modifications within the scope of the appended claims.

What we claim is:

1. A hydraulic system for actuating a gas-change valve, especially gas-change valve for combustion engines and compressors, said gas-change valve being inherently urged to its closed position by a spring, said system including a source of control fluid and comprising in combination:

a cam having a pre-ramp and a post-ramp;

an input piston actuatable by said cam and operatively connectible to the source of control fluid;

an output piston for opening said gas-change valve;

conduit means for communication between said output piston and said input piston relative to each other and relative to said source of control fluid; and infinitely adjustable throttle means as well as a permanent venting means operatively connected to said conduit means for controlling the quantity of said control fluid during operation of said system free of oscillations; and said permanent venting means being operatively connected to said conduit means at the highest point thereof and also to said source of control fluid said infinitely adjustable throttle means directly adjusting the specific lift of the gas-change valve.

2. A hydraulic system in combination according to claim 1, wherein said throttle means and said venting means are operatively connected as a unit.

3. A hydraulic system in combination according to claim 1, wherein said permanent venting means includes:

a restrictor, said restrictor having a very narrow opening area and being in communication with said conduit means; and a control fluid separator located downstream of and in communication with said restrictor and in communication with said source of control fluid.

4. A hydraulic system in combination according to claim 1, and further comprising a discharge conduit for communicating said throttle means with said source of control fluid.

5. A hydraulic system in combination according to claim 4, wherein a check-valve is arranged in said discharge conduit downstream of said throttle means, said check-valve preventing the return-flow of control fluid into said system.

6. A hydraulic system in combination according to claim 1, wherein said conduit means includes a branch conduit and a cylinder for said input piston, and further comprising:

a refilling valve operatively connected to said conduit means between said source and said cylinder;

a pump operatively connectible between said refilling valve and said source for conveying control fluid by means of said branch conduit to said cylinder;

an accumulator operatively connectible to said branch conduit between said pump and said refilling valve; and a relief valve operatively connectible between said accumulator and said pump, said relief valve being adapted to communicate with said source of control fluid.

7. A hydraulic system in combination according to claim 1, wherein said control fluid is oil.

* * * * *

UNITED STATES PATENT AND TRADEMARK OFFICE

CERTIFICATE OF CORRECTION

PATENT NO. : 4278233

DATED : 14 July 1981

INVENTOR(S) : Hansjürgen Zürner et al

It is certified that error appears in the above—identified patent and that said Letters Patent is hereby corrected as shown below:

On the Title Page, the name and address of the Assignee should read as follows:

[73] Assignee: Maschinenfabrik Augsburg-Nürnberg Aktiengesellschaft, Nürnberg, Fed. Rep. of Germany also on the Title Page, the following should be added:

[30] Foreign Application Priority Data

Sept. 16, 1978 (DE) Fed. Rep. of Germany...P2840445.

Signed and Sealed this

*Twenty-ninth* Day of *September 1981*

[SEAL]

*Attest:*

*Attesting Officer*

GERALD J. MOSSINGHOFF

*Commissioner of Patents and Trademarks*